US005294131A

United States Patent [19]

Manske

[11] Patent Number: 5,294,131

[45] Date of Patent: Mar. 15, 1994

[54] AUDIBLE ARROW

[76] Inventor: William D. Manske, 309 Robinson Dr., Algona, Iowa 50511

[21] Appl. No.: 828,160

[22] Filed: Jan. 30, 1992

[51] Int. Cl.[5] ..... F42B 6/04

[52] U.S. Cl. ..... 273/416; 181/141; 181/196; 181/199

[58] Field of Search ..... 273/416; 181/141, 184, 181/196, 198, 199; 343/386

[56] References Cited

U.S. PATENT DOCUMENTS

| | | | |
|---|---|---|---|
| 2,467,838 | 4/1949 | Lust et al. | 273/418 |
| 3,275,321 | 9/1966 | Forest . | |
| 3,735,748 | 5/1973 | Gaylord | 124/12 |
| 3,790,948 | 2/1974 | Ratkovich | 273/416 X |
| 4,083,426 | 4/1978 | Peugh | 181/199 X |
| 4,421,319 | 12/1983 | Murphy | 273/416 |
| 4,675,683 | 6/1987 | Robinson et al. | 273/416 X |
| 4,704,612 | 11/1987 | Boy et al. | 273/416 X |
| 4,749,198 | 6/1988 | Brailean | 273/416 |
| 4,836,557 | 6/1989 | Polando | 273/416 |
| 4,858,935 | 8/1989 | Capson | 273/416 |
| 4,885,800 | 12/1989 | Ragle | 273/416 X |
| 4,951,952 | 8/1990 | Saddler | 273/416 |
| 5,024,447 | 6/1991 | Jude | 273/416 |
| 5,094,463 | 3/1992 | Dryden | 273/416 |
| 5,134,552 | 7/1992 | Call et al. | 273/416 X |

*Primary Examiner*—Paul E. Shapiro

[57] ABSTRACT

A hunting arrow having a hollow shaft accommodating a sound generator actuated upon impact with a target to aid in finding the arrow. The shaft has one or more slots that function to direct the generated sound. The sound generator includes a piezio electric element and a tone control device that causes the element to emit separate sequential sounds of varying frequencies. An electrical contact mounted on the sound generator maintains continuous electric contact after impact.

27 Claims, 5 Drawing Sheets

AUDIBLE ARROW

FIELD OF THE INVENTION

The invention relates to hunting arrows having arrow location apparatus to aid in locating wounded game, more particularly, to arrows equipped with audible sound generation systems.

BACKGROUND OF THE INVENTION

Hunting arrows having audible sound generating systems are know in the art M. R. Murphy, in U.S. Pat. No. 4,421,319, discloses a hunting arrow having a sound generator, shown as a buzzer, that is connected to an electrical switch circuit with a manually operated switch. The circuit includes a timer to delay the operation of the buzzer.

Radio transmitters have been used as location apparatus with arrows. Inertia activated switches are used to turn the transmitters on. A radial receiver carried by the hunter is used for finding the direction of the arrow accommodating the transmitter. Arrows having transmitters are shown by J. M. Ratkovich, in U.S. Pat. No. 3,790,948; C. R. Robinson, B. A. Robinson, and T. Robinson, in U.S. Pat. No. 4,675,683; D. D. Boy and H. H. Frederick, in U.S. Pat. No. 4,704,612; L. D. Brailean, in U.S. Pat. No. 4,749,198; and R. R. Capson, in U.S. Pat. No. 4,858,935.

SUMMARY OF THE INVENTION

The invention is directed to an improved hunting audible arrow having impact actuated sound generating apparatus and amplification means usable to track a game animal struck by the arrow or locate an arrow that missed an animal or target. The arrow has a hollow shaft that accommodates an impact actuated sound generating apparatus whereby the flight of the arrow is not affected thereby. The impact actuated sound generating apparatus obviates the need for actuation of a manual switch to generate sound and the need for a radial receiver to find the direction of the spent arrow. Sound amplification means includes slots in the arrow shaft that function as openings to allow the sound emitted into the shaft chamber to be directed externally of the shaft. This substantially increases the audible sensing range of the arrow.

One embodiment of the hunting audible arrow has an elongated tubular shaft having an inner chamber. An arrowhead is mounted on the forward end of the shaft with a tubular insert. A sound generating apparatus operable to generate an audible sound is located within the chamber of the shaft. The sound generating apparatus has a generally tubular sleeve having a passage that accommodates an electric power source, such as one or more lithium batteries. An audible device is mounted on one end of the sleeve adjacent the power source. The audible device includes a piezio electric element and a tone generator. The tone generator controls the sound generated by the piezio electric element the generated sound can be intermittent and of different frequencies or constant at the same frequency that can be sensed by the human ear. A conductive member is mounted on the opposite end of the sleeve. The sleeve is moveable from a first OFF position to a second ON position within the chamber when the arrowhead strikes an object. The insert has a contact spring that engages the conductive member when the sleeve is in the second position. This enables the power source to supply electric energy to the piezio electric element and toner generator. The piezio electric element and tone generator are energized and an audible sound is generated. This facilities tracking and retrieval of the arrow. A spring mounted on the sleeve engages the inner wall of the shaft to hold the conductive member in engagement with the contact spring when the sleeve is in the second position. This ensures continuous sound generation. The spring has a biasing force sufficient to prevent inadvertent movement of the sleeve within the chamber. A stop secured to the shaft is engageable with the sleeve to limit the backward movement of the sleeve within the chamber and locate the sleeve in the OFF position. One or more circumferentially spaced slots provided in the rear portion of the shaft are open to the chamber of the shaft. The lengths of the slots may be varied in width and length so that sound of different frequencies can be amplified. The amplified sound increases the audible sensing range of the arrow and conserves the energy level of the power source. A radio receiver is not used to locate the arrow.

Another embodiment of the audible arrow has an elongated linear tubular shaft accommodating a sleeve at the forward end thereof. A broad head is attached to the sleeve. A sound generating apparatus located within the shaft is connected to the sleeve. The sound generating apparatus has a body with chamber accommodating a battery. The battery has longitudinal movement between an OFF position and an ON position. When the arrowhead strikes a target, the battery moves from the OFF position to the ON position to close the electric circuit of the sound generator component. The sound signals are preferable intermittent and are directed into the chamber of the shaft. One or more slots in the rear portion of the shaft direct amplified sound signals away from the arrow thereby providing sound signals which reveal the location of the arrow.

DESCRIPTION OF THE PREFERRED EMBODIMENT

Figure 1:
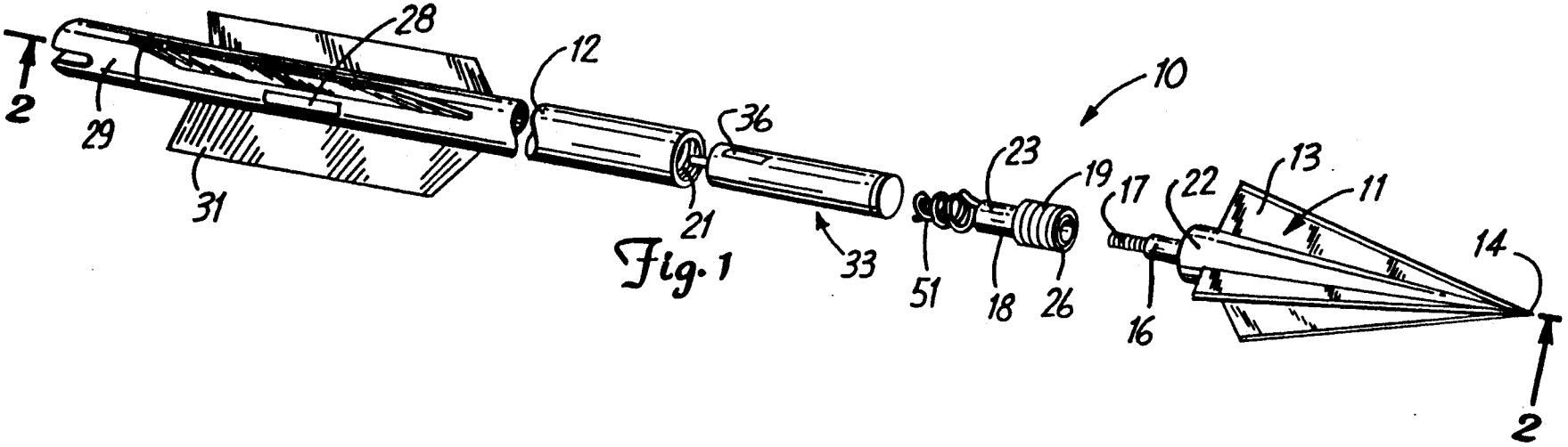
FIG. 1 is an exploded view of the audible arrow of the invention.
Figure 2:
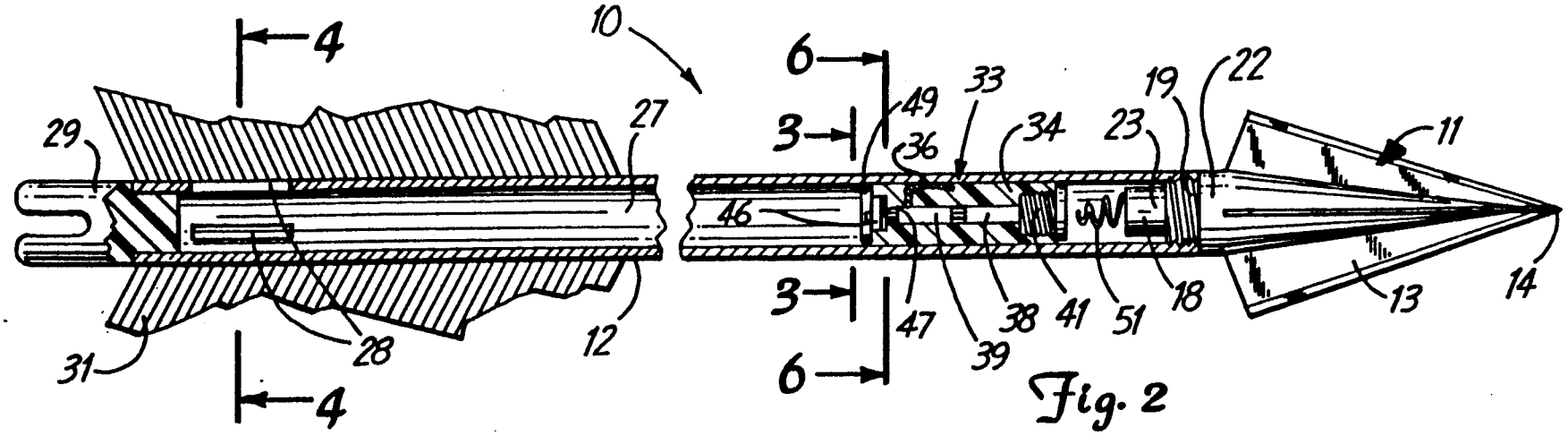
FIG. 2 is an enlarged foreshortened sectional view taken along line 2—2 of FIG. 1.

Referring to FIGS. 1 and 2, there is shown a hunting audible arrow of the invention indicated generally at 10, accommodating sound generating apparatus 33 which is activated when arrow 10 strikes or hits a target, such as a game animal to allow tracking and retrieval of arrow 10 and the animal. The sound generating apparatus 33 is located within hollow shaft 12 of the arrow 10 whereby the flight of arrow 10 is not affected thereby. The impact actuated sound generating apparatus 33 does not require actuation of a manually operated switch to generate sound. Valuable seconds are saved in aiming and preparing the arrow for flight toward the animal which may be moving quickly through an area. The shaft 12 of arrow 10 has slots 28 open to the chamber of the shaft 12 that promote sound amplification so that the sound signals are readily detected by a human ear at greater distances. Further, the use of a radio receiver is not required to track the signal. The sound generating apparatus 33 is operable to emit intermittent sounds of different frequencies whereby sound detection is increased and the energy level of the power source is conserved. Sound generating devices that provide constant sounds can be used with arrow 10.

Arrow 10 has a removable arrowhead 11 attached to the forward end of an elongated cylindrical hollow shaft 12, such as an aluminum tube. Arrowhead 11 is a conventional broadhead hunting arrowhead. Other types of arrowheads can be used with arrow 10. Arrowhead 11 has a plurality of fins or blades 13 that incline forwardly and inwardly to a tip 14. The opposite end of arrowhead 11 has an extension 16 having a threaded end portion 17. A tubular insert 18 having a plurality of external threads 19 engageable with the threaded forward end 21 of shaft 12 accommodates extension 16 and threaded end 17 to mount arrowhead 11 on shaft 12. A collar 22 surrounding extension 16 adjacent blades 13 engages the outer end of shaft 12 to hold arrowhead 11 on shaft 12.

Figure 5:
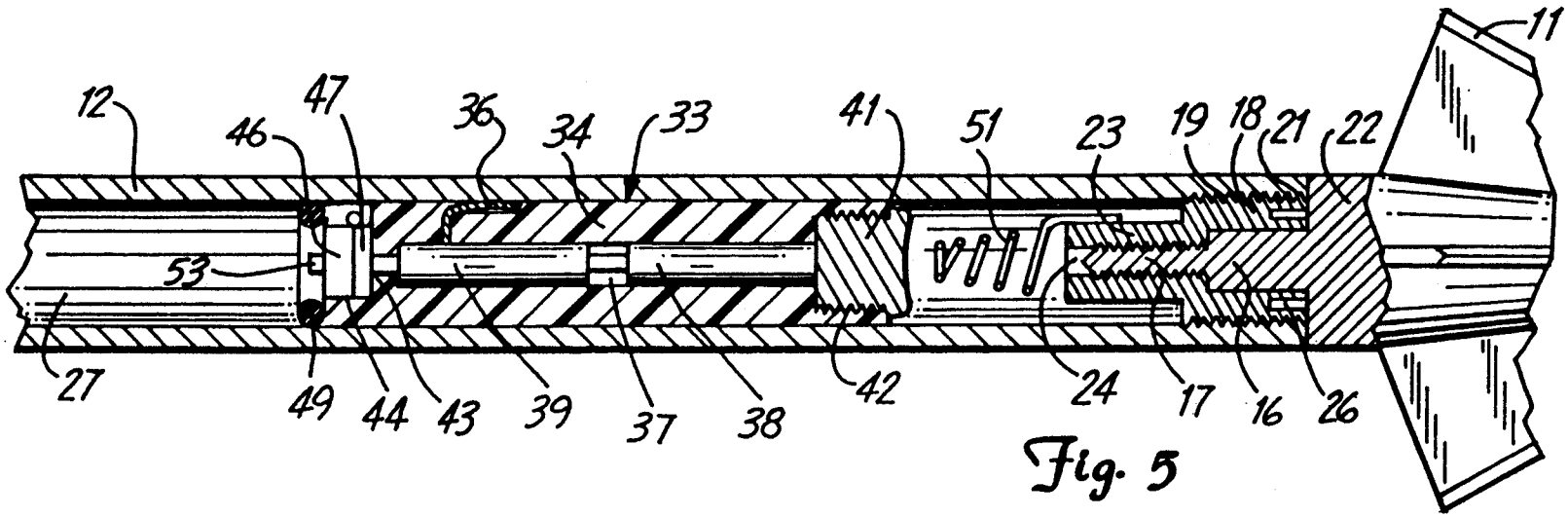
FIG. 5 is an enlarged sectional view of the arrow of FIG. 1 showing the arrangements of parts when the sound generating apparatus is in the OFF position.

Referring to FIG. 5, insert 18 is a generally tubular member having a boss 23 provided with an axial threaded bore 24 for accommodating threaded end 17 of arrowhead extension 16. Insert 18 is threaded into the forward end 21 of shaft 12 whereby the outer end of the insert is flush with the end of the shaft. Insert 18 has a plurality of lock wrench holes 26 to facilitate the threading of the insert into shaft end 21. Threaded end 17 of arrowhead 11 is then threaded into bore 24 of insert 18 so that collar 22 engages the ends of the insert and shaft 12. Alternatively, insert 18 can be threaded on arrowhead 11 and then the insert and arrowhead can be attached to the forward end 21 of shaft 12 as a unit.

Figure 4:
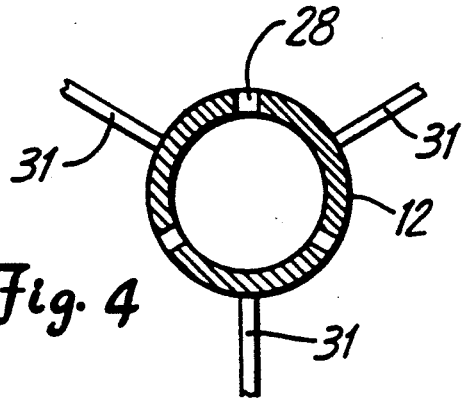
FIG. 4 is an enlarged sectional view taken along line 4—4 of FIG. 2.

Referring to FIG. 2, shaft 12 of arrow 10, shown as a hollow metal tube, has an elongated cylindrical chamber 27. The inside wall of shaft 12 has a smooth cylindrical surface and a uniform diameter throughout its length. Other materials can be used to make shaft 12. The outer peripheral surface of shaft 12 has a plurality of circumferentially spaced longitudinal slots or openings 28 adjacent nock 29. As shown in FIG. 4, slots 28 are located between circumferentially spaced fletchings or flight stabilizing feathers 31 that are secured to the rear end portion of shaft 12. Each slot 28 is circumferentially spaced from and extends generally parallel to adjacent feathers 31. Slots 28 have lengths that are less than the lengths of feathers 31. Slots 28 in the rear or trailing end of shaft 12 allow amplified sound to emerge from shaft 12 into the surrounding environment. The amplified sound permits the archer to track and retrieve arrow 10 and the wounded game animal at substantial distances. The length and/or the width of each slot 28 can be varied to vary the sound output. This allows the sound signal to be more readily sensed by the archer at greater distances.

Figure 6:
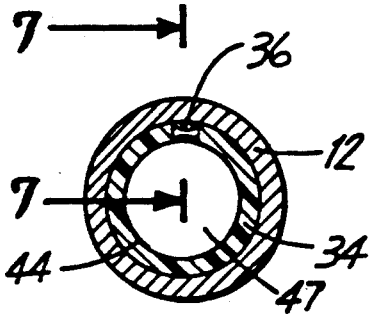
FIG. 6 is an enlarged sectional view taken along line 6—6 of FIG. 2.
Figure 7:
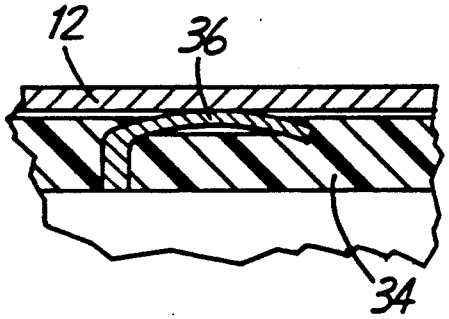
FIG. 7 is an enlarged sectional view taken along line 7—7 of FIG. 6.

Arrow 10 has an impact actuated sound generating apparatus indicated generally at 33 for generating an audible sound to allow tracking and retrieval of the arrow and the animal. As shown in FIGS. 2 and 6, sound generating apparatus 33 is a generally cylindrical member that is positioned in chamber 27 behind insert 18. Apparatus 33 has a generally tubular body or sleeve 34 of plastic or other electrical insulation material having an outer diameter substantially the same as the diameter of chamber 27 whereby sleeve 34 has a light friction fit with the inner cylindrical surface of shaft 12. As shown in FIG. 7, a generally U-shaped spring 36 secured to the back end of sleeve 34 engages the inner wall of shaft 12 to releasably hold and maintain the position of apparatus 33 within shaft 12. When arrowhead 11 hits an object, the impact force overcomes the biasing force of spring 36 whereby sound generating apparatus 33 slides forwardly in chamber 27 to the OFF position. The impact force required to overcome the biasing force of spring 36 is approximately 20 to 25 pounds of pressure. Apparatus 33 can be moved rearwardly in chamber 27 to the OFF position by whipping or snapping arrow 10 in a backward motion.

Referring to FIG. 5, sleeve 34 has a passage 37 accommodating a power source, such as batteries 38 and 39. Batteries 38, 39 are conventional cylindrical three-volt lithium batteries that are located in end-to-end relation and extend along the entire length of passage 37. An electrical conducting element, such as a metal screw or plug 41, having external threads is threaded into a bore 42 in the front end of sleeve 34 to close one end of passage 37. The inner end of plug 41 engages the positive terminal of battery 38. The opposite end of passage 37 has an annular shoulder 43 that projects into the passage and engages the negative terminal end of battery 39 to retain batteries 38 and 39 within passage 37. The distance between the inner surface of shoulder 43 and the inner end of bore 42 is substantially the same as the distance between the negative terminal end of battery 39 and the positive terminal of battery 38 whereby the negative terminal of battery 38 is held in engagement with the positive terminal of battery 39 when plug 41 is threaded into bore 42. Batteries 38 and 39 can be removed and replaced by removing plug 41 from sleeve 34.

The back end of sleeve 34 has a cylindrical recess 44 adjacent shoulder 43 that is open to passage 37. An audible vibrator member 46, such as a piezio electric cell, coil transducer, and the like, and a tone generator 47 are mounted within recess 44. Member 46 has a coil transducer or speaker 53 facing chamber 27 that is operable to generate an audible sound, indicated by line waves 48, in FIG. 9, when subject to electric power.

Figure 8:
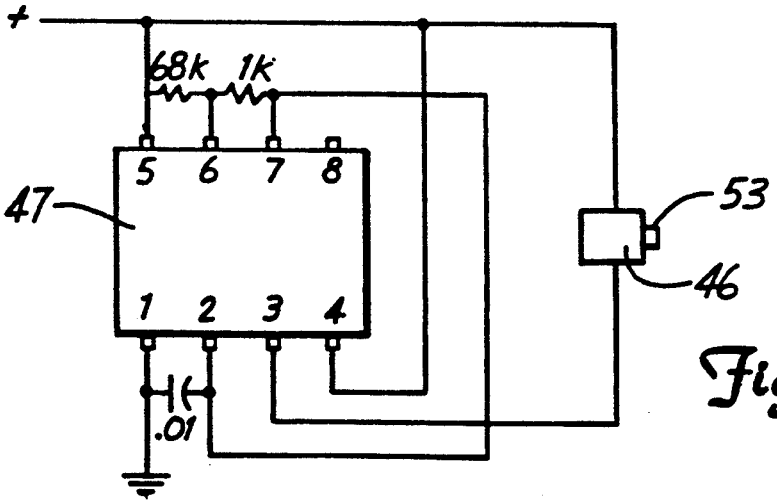
FIG. 8 is a diagrammatic view showing the circuitry for the piezio electric member and tone generator of the sound generating apparatus.

As shown in FIG. 8, tone generator 47 is electrically connected to piezio electric member 46. Tone generator 47 controls the sound signals generated by member 46 so that the sound signal is intermittent and of different frequencies. This increases the probability of signal detection by the hunter and also conserves the energy of batteries 38 and 39. An example of a tone generator 47 usable with arrow 10 is a 556 timer IC, which is a digitalized sound generator. A tone generator having a continuous or intermittent sound signal control can be used in the sound generating device. The electronic components and wiring arrangement between tone generator 47 and audible vibrator 46 is shown in FIG. 8.

Figure 3:
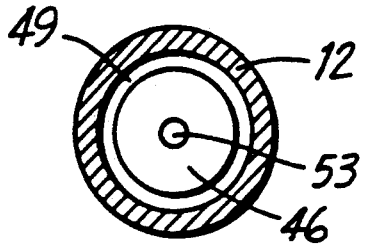
FIG. 3 is an enlarged sectional view taken along line 3—3 of FIG. 2.

As shown in FIGS. 3, 5 and 6, piezio electric member 46 and tone generator 47 have generally cylindrical housings that are mounted in recess 44 in the rear end of sleeve 34 in stacked relation. Tone generator 47 is located in the inner portion of recess 44. The negative terminal of battery 39 extends through passage 37 adjacent shoulder 43 and engages generator 47. Piezio electric member 46 is located in the outer portion of recess 44 adjacent the end of sleeve 34. The outer diameters of member 46 and generator 47 are the same as the diameter of recess 44 whereby member 46 and generator 47 fit tightly in the recess. The outer face of member 46 is flush with the end of sleeve 34. As shown in FIG. 3, the center of the outer face of member 46 has a speaker 53 facing chamber 27 from which sound 48 is emitted when sound generating apparatus 33 is energized.

Referring to FIG. 5, sound generating apparatus 33 is normally spaced from an electrical contact coil spring 51 attached to boss 23 of insert 18 to interrupt the power circuit to piezio electric member 46 and tone generator 47. The rear end of sleeve 34 engages a split ring stop 49 to locate apparatus 33 in the OFF position wherein the electric circuit of sound generator 33 is open. A U-shaped spring 36 engages the inner surface of shaft 12 to releasably hold and maintain apparatus 33 in the OFF position. Sleeve 34 has a light friction fit within shaft 12 whereby when arrowhead 11 strikes an object, the momentum of sound generating apparatus 33 overcomes the biasing force of spring 36 and the apparatus will slide forwardly until metal plug 41 engages contact spring 51 to close the circuit for piezio electric member 46 and tone generator 47, whereby electric power stored in batteries 38 and 39 cause member 46 and generator 47 to generate audible sound so that the location of arrow 10 can be determined. The impact force necessary to overcome the biasing force of spring 36 is approximately 20 to 25 pounds of pressure. Contact spring 51 absorbs a portion of the momentum of the sound generating apparatus 33 preventing apparatus 33 from rebounding off boss 23 out of engagement with the contact spring 51.

Spring 36 ensures continuous electrical contact between plug 41 and contact spring 51. Movement of the fleeing wounded animal does not separate plug 41 from contact spring 51 whereby apparatus 33 continues to generate an audible signal allowing arrow 10 and the animal to be tracked and retrieved. After retrieval, the hunter can disconnect plug 41 from contact spring 51 to turn off sound generating apparatus 33 by merely snapping the arrow in a backward motion to slide the apparatus rearwardly. The rear end of sleeve 34 engages stop 49 to prevent sound generating apparatus 33 from moving into the rear portion of chamber 27 and to locate the apparatus in the open position. Stop 49 is an expansion ring frictionally retained in shaft chamber 27.

Figure 9:
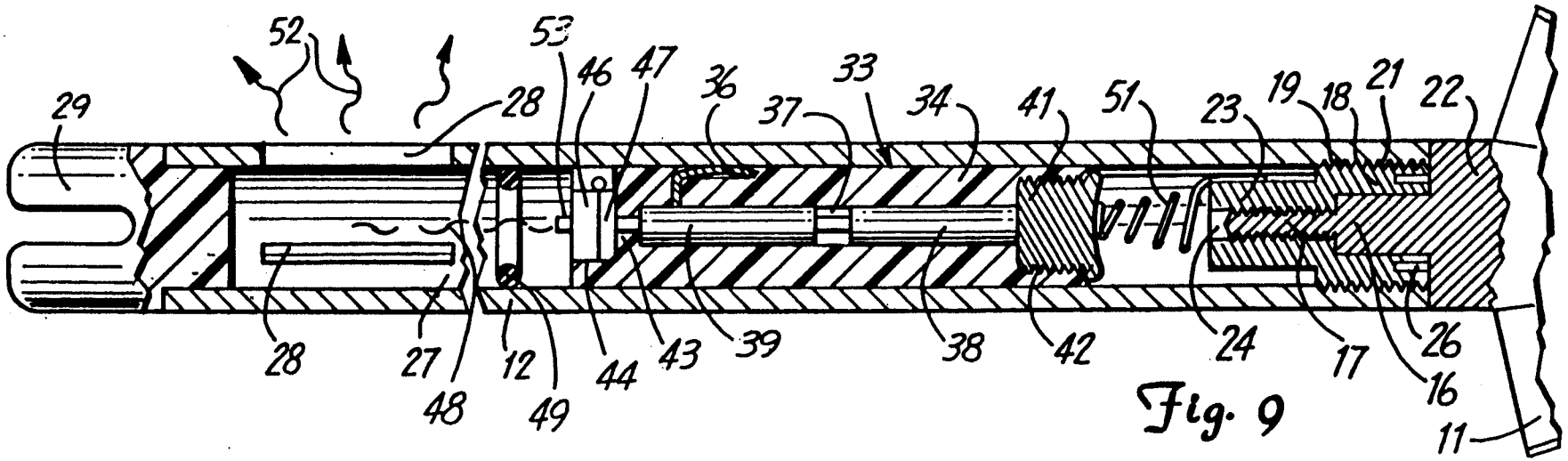
FIG. 9 is a view similar to FIG. 5 showing the arrangement of parts when the sound generating apparatus is in the ON position.

In use, with the impact actuated sound generating apparatus 33 in the OFF position, as shown in FIG. 5, arrow 10 is shot toward a target, such as a game animal. When arrowhead 11 strikes the animal, the impact force of the arrowhead causes sound generating apparatus 33 to slide forwardly in chamber 27 of shaft 12 until metal plug 41 engages contact spring 51, as shown in FIG. 9. This closes the circuit for piezio electric member 46 and tone generator 47 whereby electric power from batteries 38 and 39 is supplied to member 46 and generator 47. The electric power causes piezio electric member 46 to emit audible sound signals indicated by line waves 48. The sound signals are within a range of frequencies that can be detected by the normal human ear. The sound signals are directed into chamber 27 from speaker 53 of piezio electric member 46. The sound signals can be intermittent and of different frequencies. Signal detection is increased and the electric power of batteries 38 and 39 is conserved when the sound signals are intermittent. The relatively small elongated chamber 27 along with the slots 28 causes sound signals to be focused, amplified and directed away from arrow 10, as shown by arrows 52 in FIG. 9, whereby the sound signals are readily detected by a human ear and the audible sensing range of arrow 10 is substantially increased. U-shaped spring 36 ensures continuous electrical contact and signal generation notwithstanding movement of the wounded animal.

Impact actuated sound generating apparatus 33 does not disturb the flight and accuracy of arrow 10. Arrow 10 does not have a manual switch that is required to be activated prior to shooting the arrow. Upon sighting a game animal, the hunter simply shoots the arrow at the animal and when the arrow hits the target on impact actuated sound is generated to allow tracking and retrieval of the arrow and animal. The use of a receiver is not necessary to track the sound signal.

Figures 10, 11, 12, 13:
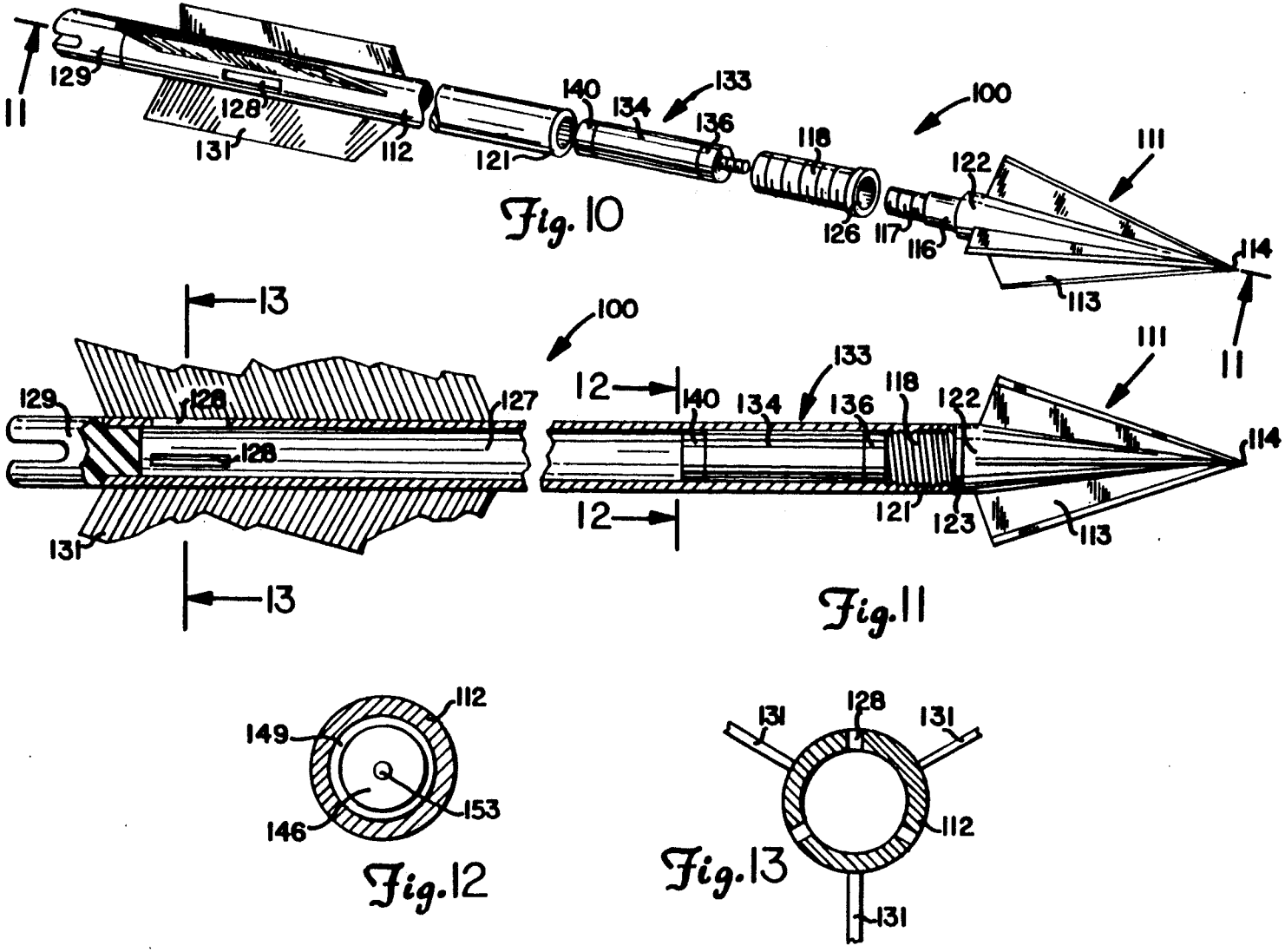
FIG. 10 is a foreshortened exploded perspective view of a modification of the audible arrow of the invention.
FIG. 11 is an enlarged foreshortened sectional view taken along line 11—11 of FIG. 10.
FIG. 12 is an enlarged sectional view taken along the line 12—12 of FIG. 11.
FIG. 13 is an enlarged sectional view taken along line 13—13 of FIG. 11.

Referring to FIGS. 10 and 11, there is shown a modification of the hunting audible arrow of the invention indicated generally at 100, accommodating sound generating apparatus 133 which is activated when arrow 100 strikes or hits a target, such as a game animal to allow tracking and retrieval of arrow 100 and the animal. The sound generating apparatus 133 is a compact, lightweight unit located within hollow shaft 112 of arrow 100 whereby the flight of arrow 100 is not affected thereby. The impact actuated sound generating apparatus 133 does not require actuation of a manually operated switch to generate sound. Valuable seconds are saved in aiming and preparing the arrow for flight toward the animal which may be moving quickly through an area. Shaft 112 of arrow 100 has longitudinal slots 128 open to the chamber of the shaft 112 that promote sound amplification so that the sound signals are readily detected by a human ear at greater distances. Further, the use of a radio receiver is not required to track the signal. The sound generating apparatus 133 is operable to emit intermittent sounds of different frequencies whereby sound detection is increased and the energy level of the power source is conserved. Sound generating devices that provide constant sounds can be used with arrow 100.

Arrow 100 has a removable arrowhead 111 attached to the forward end of an elongated cylindrical hollow shaft 112, such as an aluminum tube. Arrowhead 111 is a conventional broadhead hunting arrowhead. Other types of arrowheads can be used with arrow 100. Arrowhead 111 has a plurality of fins or blades 113 that incline forwardly and inwardly to a tip 114. The opposite end of arrowhead 111 has a cylindrical extension 116 having a threaded end 117. A tubular insert 118 having a threaded passage 119 is turned into the threaded forward end 121 of shaft 112 and accommodates extension 116 and threaded end 117 to mount arrowhead 111 on shaft 112. A collar 122 surrounding extension 116 adjacent blades 113 engages the outer end of shaft 112 to hold arrowhead 111 on shaft 112.

Figure 14:
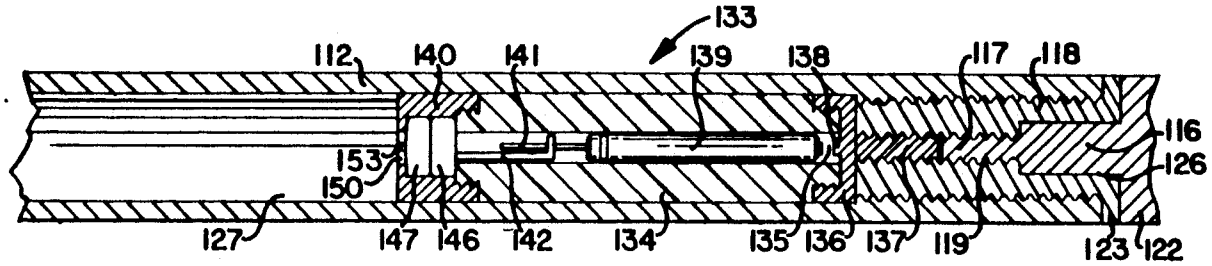
FIG. 14 is an enlarged sectional view of the broadhead end of the audible arrow of FIG. 10 showing the arrangement of parts when the sound generating apparatus is in the OFF position.

Referring to FIG. 14, insert 118 is a generally tubular member having a collar 123 provided with an axial bore 126 for accommodating extension 116. Insert 118 is threaded into the forward end 121 of shaft 112 whereby collar 123 is flush with the end of shaft 112. Threaded end 117 of arrowhead 111 is then threaded into passage 119 of insert 118 so that collar 122 engages the insert. Alternatively, insert 118 can be threaded on arrowhead 111 and then the insert and arrowhead can be attached to the forward end 121 of shaft 112 as a unit.

Referring to FIG. 11, shaft 112 of arrow 100, shown as a hollow metal tube, has an elongated cylindrical chamber 127. The inside wall of shaft 112 has a smooth cylindrical surface and a uniform diameter throughout its length. Other materials can be used to make shaft 112. The outer peripheral surface of shaft 112 has a plurality of circumferentially spaced longitudinal slots or openings 128 adjacent nock 129. As shown in FIG. 13, slots 128 are located between circumferentially spaced fletchings or flight stabilizing feathers 131 that are secured to the rear end portion of shaft 112. Each slot 128 is circumferentially spaced from and extends generally parallel to adjacent feathers 131. Slots 128 have lengths that are less than the lengths of feathers 131. Slots 128 in the rear or trailing end of shaft 112 allow amplified sound to emerge from shaft 112 into the surrounding environment. The amplified sound permits the archer to track and retrieve arrow 100 and the wounded game animal at substantial distances. The length and/or the width of each slot 128 can be varied to vary the sound output. This allows the sound signal to be more readily sensed by the archer at greater distances.

Figure 15:
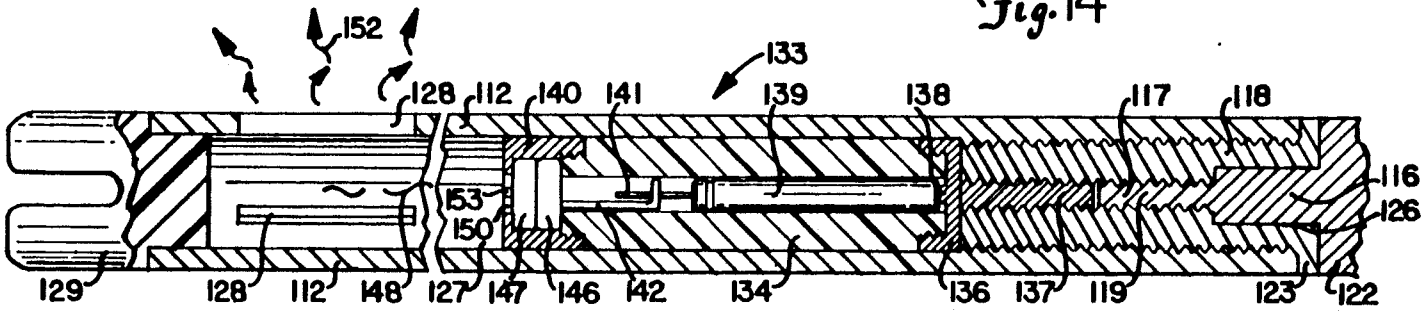
FIG. 15 is an enlarged foreshortened sectional view of the audible arrow of FIG. 10 showing the arrangement of parts when the sound generating apparatus is in the ON position.

Arrow 100 has an impact actuated sound generating apparatus indicated generally at 133 for generating an audible sound to allow tracking and retrieval of the arrow and the animal. As shown in FIGS. 14 and 15, sound generating apparatus 133 is a generally cylindrical member that is positioned in chamber 128 behind insert 118. Apparatus 133 has a generally tubular body or sleeve 134 of plastic or other electrical insulation material having an outer diameter substantially the same as the diameter of chamber 127 whereby sleeve 134 has a light friction fit with the inner cylindrical surface of shaft 112. As shown in FIG. 14, a metal, generally annular member or cap 140 secured to the back end of sleeve 134 engages the inner wall of shaft 112 to make electrical contact with shaft 112. When arrowhead 111 hits an object, the impact force causes battery 139 to engage contact 138 whereby sound generating apparatus 133 is activated to generate sound as herein described. Apparatus 133 can be turned to the OFF position by whipping or snapping arrow 100 in a backward motion.

Referring to FIG. 14 and 15, sleeve 134 has a passage 135 accommodating a power source, such as a battery 139. Battery 139 is a conventional cylindrical three-volt lithium battery having an elongated stem 141. An electrical conductor element 142 connects stem 141 to tone generator 147. Element 142 has a hole or slot accommodating stem 141 to allow battery 139 to move in passage 135 while maintaining electrical contact with tone generator 147. Battery 139 can be removed and replaced by removing Cap 136 from sleeve 134.

Member 140 has a cylindrical recess and an opening 150 in the outer end thereof. An audible vibrator member 147, such as a piezio electric cell, coil transducer, and the like, and a tone generator 146 are mounted within recess of cap 140. Member 147 has a coil transducer or speaker 153 facing chamber 127 that is operable to generate an audible sound, indicated by line waves 148, in FIG. 15, when subject to electric power.

Figure 16:
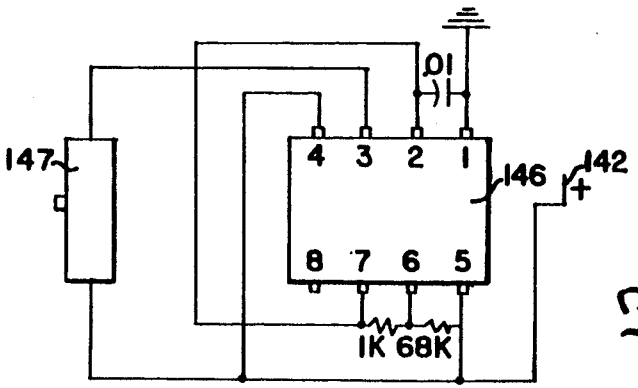
FIG. 16 is a diagrammatic view showing the electric circuit for the sound generating apparatus.

As shown in FIG. 16, tone generator 146 is electrically connected to piezio electric member 147. Tone generator 146 controls the sound signals generated by member 147 so that the sound signal is intermittent and of different frequencies. This increases the probability of signal detection by the hunter and also conserves the energy of battery 139. An example of a tone generator 146 usable with arrow 100 is a 556 timer IC, which is a digitalized sound generator. A tone generator having a continuous or intermittent sound signal control an be used in the sound generating device. The electronic components and wiring arrangement between tone generator 146 and member 147 is shown in FIG. 16.

As shown in FIGS. 14 and 15, piezio electric member 147 and tone generator 146 have generally cylindrical structures that are mounted in the recess in cap 140 in stacked relation. Tone generator 146 is located in the inner portion of the recess. Piezio electric member 147 is located in the outer portion of the recess adjacent the opening in cap 150. The outer diameters of member 147 and generator 146 are the same as the diameter of recess whereby member 147 and generator 146 fit tightly in the recess. As shown in FIG. 3, the center of the outer face of member 147 has a speaker 153 facing chamber 127 from which sound 148 is emitted when sound generating apparatus 133 is energized.

Referring to FIG. 14, sound generating apparatus 133 is normally spaced from an electrical contact 138 attached to cap 136 to interrupt the power circuit to piezio electric member 147 and tone generator 146. Battery 139 has a light friction fit within passage 135 whereby when arrowhead 111 strikes an object, the momentum of battery 139 overcomes the friction holding forces so that the battery will slide forwardly until it engages contact 138 and maintains contact with conductor element 142 to close the circuit for piezio electric member 147 and tone generator 146, whereby electric power stored in battery 139 causes member 147 and generator 146 to generate audible sound so that the location of arrow 100 can be determined.

Movement of the fleeing wounded animal does not separate battery 139 from contact 138 whereby apparatus 133 continues to generate audible signals allowing arrow 100 and the animal to be tracked and retrieved. After retrieval, the hunter can disconnect battery 139 from contact 138 to turn off sound generating apparatus 133 by merely snapping the arrow in a backward motion to slide the battery 139 rearwardly. Cap 136 being secured to sleeve 118 prevents sound generating apparatus 133 from moving into the rear portion of chamber 127.

In use, with the impact actuated sound generating apparatus 133 in the OFF position, as shown in FIG. 14, arrow 100 is shot toward a target, such as a game animal. When arrowhead 111 strikes the animal, the impact force of the arrowhead causes battery 139 to slide forwardly in chamber 135 of body 134 until battery 139 engages contact 138, as shown in FIG. 15. This closes the circuit for piezio electric member 147 and tone generator 146 whereby electric power from battery 139 is supplied to member 147 and generator 146. The electric power causes piezio electric member 147 to emit audible sound signals indicated by line waves 148. The sound signals are within a range of frequencies that can be detected by the normal human ear. The sound signals are directed into chamber 127 from speaker 153 of piezio electric member 147. The sound signals can be intermittent and of different frequencies. Signal detection is increased and the electric power of battery 139 is conserved when the sound signals are intermittent. The relatively small elongated chamber 127 along with the slots 128 causes sound signals to be focused, amplified and directed away from arrow 100, as shown by arrows 152 in FIG. 15, whereby the sound signals are readily detected by a human ear and the audible sensing range of arrow 100 is substantially increased.

Impact actuated sound generating apparatus 133 does not disturb the flight and accuracy of arrow 100. Arrow 100 does not have a manual switch that is required to be activated prior to shooting the arrow. Upon sighting a game animal, the hunter simply shoots the arrow at the animal and when the arrow hits the target on impact actuated sound is generated to allow tracking and retrieval of the arrow and animal. The use of a receiver is not necessary to track the sound signal.

While there has been shown and described preferred embodiments of the impact generated sound arrow of the invention it is understood that changes in the structure, arrangement of structure, and materials may be made by those skilled in the art without departing from the invention. The invention is defined in the following claims.

I claim:

1. An arrow comprising; an elongated shaft having a chamber, an arrowhead mounted on one end of the shaft, sound generation means operable to generate audible sound signals located within said chamber, the sound generation means being moveable from a first OFF position to a second ON position within the chamber when the arrowhead strikes an object, and power source means located in the chamber supplying energy to the sound generation means when the sound generation means is in the ON position whereby the sound generation means is energized and generates the audible sound signals to facilitate tracking and retrieval of the arrow.

2. The arrow of claim 1 including: amplification means adapted to amplify the sound signals generated by the sound generation means.

3. The arrow of claim 2 wherein: the shaft is a tubular shaft having a chamber accommodating the sound generation means, the amplification means including at least one slot in the tubular shaft open to the chamber remote from the sound generation means.

4. The arrow of claim 1 wherein: the sound generation means includes a sleeve having a passage accommodating the power source means, audible sound generator means mounted on one end of the sleeve adjacent the power source means, the sleeve being moveable from the OFF position to the ON position when the arrowhead strikes the object, the power source supplying energy to the audible sound generator means when the sleeve is in the ON position whereby the audible sound generator means is energized and generates the audible sound signals.

5. The arrow of claim 4 including: biasing means mounted on the sleeve engageable with the shaft to hold the sleeve in the ON position thereby ensure continuous sound generation.

6. The arrow of claim 4 wherein: the audible sound generator means comprises sound cell means for generating the sound signals, and tone generation means operable to control the sound signals generated by the sound cell means whereby the sound is intermittent.

7. The arrow of claim 6 wherein: the sound cell means is a piezio electric element.

8. The arrow of claim 4 including: stop means secured to the shaft engageable with the sleeve to limit backward movement of the sleeve within the chamber and locate the sleeve in the OFF position.

9. The arrow of claim 1 wherein: the power source means comprises at least one lithium battery.

10. The arrow of claim 1 including: insert means mounted on the end of the shaft for accommodating the arrowhead, the insert means having contact means engageable with the sound generation means when the sound generation means is in the ON position enabling the power source to supply energy to the sound generation means.

11. The arrow of claim 10 including: biasing means mounted on the second generation means engageable with the shaft to hold the sound generation means in engagement with the contact means when the sound generation means is in the second position thereby ensure continuous sound generation.

12. The arrow of claim 10 wherein: the contact means includes a coil spring.

13. An arrow comprising: an elongated tubular shaft having an inner chamber, the shaft having a forward end and a rear end, an arrowhead mounted on the forward end, means for generating audible sound signals located within the chamber, the means for generating audible sound signals comprising a sleeve having a passage, battery means located within the passage, audible sound generator means mounted on one end of the sleeve adjacent the battery means, the sleeve being moveable from a first position to a second position when the arrowhead strikes an object with a predetermined force, the battery means providing electric power to the audible sound generator means when the sleeve is in the second position whereby the audible sound generator means is energized and generates the audible sound signals to facilitate tracking and retrieval of the arrow.

14. The arrow of claim 13 including: amplification means adapted to amplify the sound signals generated by the audible sound generator means, the amplification means including a plurality of slots open to the chamber adjacent the rear end of the shaft.

15. The arrow of claim 14 wherein: the slots are circumferentially spaced relative to each other.

16. The arrow of claim 14 wherein: at least one slot has a length different from the lengths of adjacent slots.

17. The arrow of claim 13: including biasing means mounted on the sleeve engageable with the shaft to hold the sleeve in the second position thereby ensure continuous sound generation.

18. The arrow of claim 13 wherein: the audible sound generator means comprises sound cell means for generating the sound signals, tone generator means operable to control the sound signals generated by the sound cell means whereby the sound signals are intermittent.

19. The arrow of claim 18 wherein: the sound cell means is a piezio electric element.

20. The arrow of claim 13 including: conductive means mounted on an end of the sleeve opposite the audible sound generator means, and insert means mounted on the forward end of the shaft for accommodating the arrowhead, the insert means having contact means engageable with the conductive means when the sleeve is in the second position enabling the battery means to supply electric power to the audible sound generator means.

21. The arrow of claim 20 including: biasing means mounted on the sleeve engageable with the shaft to hold the conductive means in engagement with the contact means when the sleeve is in the second position thereby ensure continuous sound generation.

22. A locating apparatus for an arrow having a tubular shaft with a chamber, and an arrowhead mounted on one end of the shaft, comprising: impact actuated means for generating audible sound signals adapted to be located within the shaft, the impact actuated means being moveable from an OFF position to a ON position within the shaft when the arrowhead hits an object thereby causing the audible sound to be generated, biasing means mounted on the impact actuated means engageable with the shaft to hold the impact actuated means in the ON position thereby ensuring continuous sound generation, and means for amplifying the sound signals generated by the impact actuated means whereby locating the arrow is facilitated.

23. The apparatus of claim 22 wherein: the impact actuated means includes sound cell means for generating the sound signals, and tone generator means for controlling the sound signals emitted from the sound cell means so that the sound is intermittent and of different frequencies.

24. The apparatus of claim 23 wherein: the sound cell means is a piezio electric element.

25. The apparatus of claim 22 including: insert means mounted on the end of the shaft, the insert means including a contact spring engageable with the impact actuated means when the impact actuated means is in the ON position enabling the audible sound signals to be generated.

26. The apparatus of claim 25 wherein: the biasing means is a U-shaped spring extending from the impact actuated means and engageable with an inner wall of the shaft, the U-shaped spring having a biasing force to hold the impact actuated means in engagement with the contact spring when the impact actuated means is in the second position thereby ensure continuous sound signal generation.

27. The apparatus of claim 22 wherein: the means for amplifying the sound signals includes a plurality of slots provided in the shaft open to the chamber.

* * * * *